US007059837B2

(12) United States Patent
Nichol et al.

(10) Patent No.: US 7,059,837 B2
(45) Date of Patent: Jun. 13, 2006

(54) VARIABLE SPEED OIL-INJECTED SCREW COMPRESSORS

(75) Inventors: Philip Nichol, Wycombe (GB); Lyndon Paul Fountain, Haddenham (GB)

(73) Assignee: CompAir UK Limited, High Wycombe (GB)

( * ) Notice: Subject to any disclaimer, the term of this patent is extended or adjusted under 35 U.S.C. 154(b) by 369 days.

(21) Appl. No.: 10/381,101

(22) PCT Filed: Sep. 24, 2001

(86) PCT No.: PCT/GB01/04275

§ 371 (c)(1),
(2), (4) Date: Jul. 17, 2003

(87) PCT Pub. No.: WO02/25114

PCT Pub. Date: Mar. 28, 2002

(65) Prior Publication Data

US 2004/0096333 A1 May 20, 2004

(30) Foreign Application Priority Data

Sep. 25, 2000 (GB) ..... 0023459.1

(51) Int. Cl.
*F04B 23/14* (2006.01)

(52) U.S. Cl. ..... 417/201; 417/228; 184/6.16; 184/6.22

(58) Field of Classification Search ..... 417/228, 417/201; 184/6.22, 6.16
See application file for complete search history.

(56) References Cited

U.S. PATENT DOCUMENTS

| | | | | |
|---|---|---|---|---|
| 4,063,855 | A * | 12/1977 | Paul | 418/84 |
| 4,526,523 | A * | 7/1985 | Parker | 418/84 |
| 5,310,020 | A * | 5/1994 | Martin et al. | 184/6.3 |
| 5,522,233 | A * | 6/1996 | Nares et al. | 62/193 |
| 5,927,088 | A * | 7/1999 | Shaw | 62/175 |
| 6,077,052 | A | 6/2000 | Gunn et al. | |

FOREIGN PATENT DOCUMENTS

| | | |
|---|---|---|
| JP | 090203385 | 8/1997 |
| JP | 100184571 | 7/1998 |
| JP | 110037053 | 2/1999 |

* cited by examiner

*Primary Examiner*—Tae Jun Kim
*Assistant Examiner*—Ryan Gillan
(74) *Attorney, Agent, or Firm*—Dykema Gossett PLLC

(57) ABSTRACT

The invention relates to the use of variable speed control of the cooling fan on a variable speed oil-injected screw compressor. A screw compressor (11) comprises at least one stage of compression, each with a pair of rotors, variable speed compressor drive means (12), an oil reclaimer (13) from the compressed air and cooling apparatus (17) for cooling the oil extracted from the compressed air. The cooling apparatus comprises a heat exchange device and a fan (18) driven by a motor (19) which can be run at different speeds.

8 Claims, 1 Drawing Sheet

VARIABLE SPEED OIL-INJECTED SCREW COMPRESSORS

BACKGROUND OF THE INVENTION

1. Field of the Invention

Figure 1:
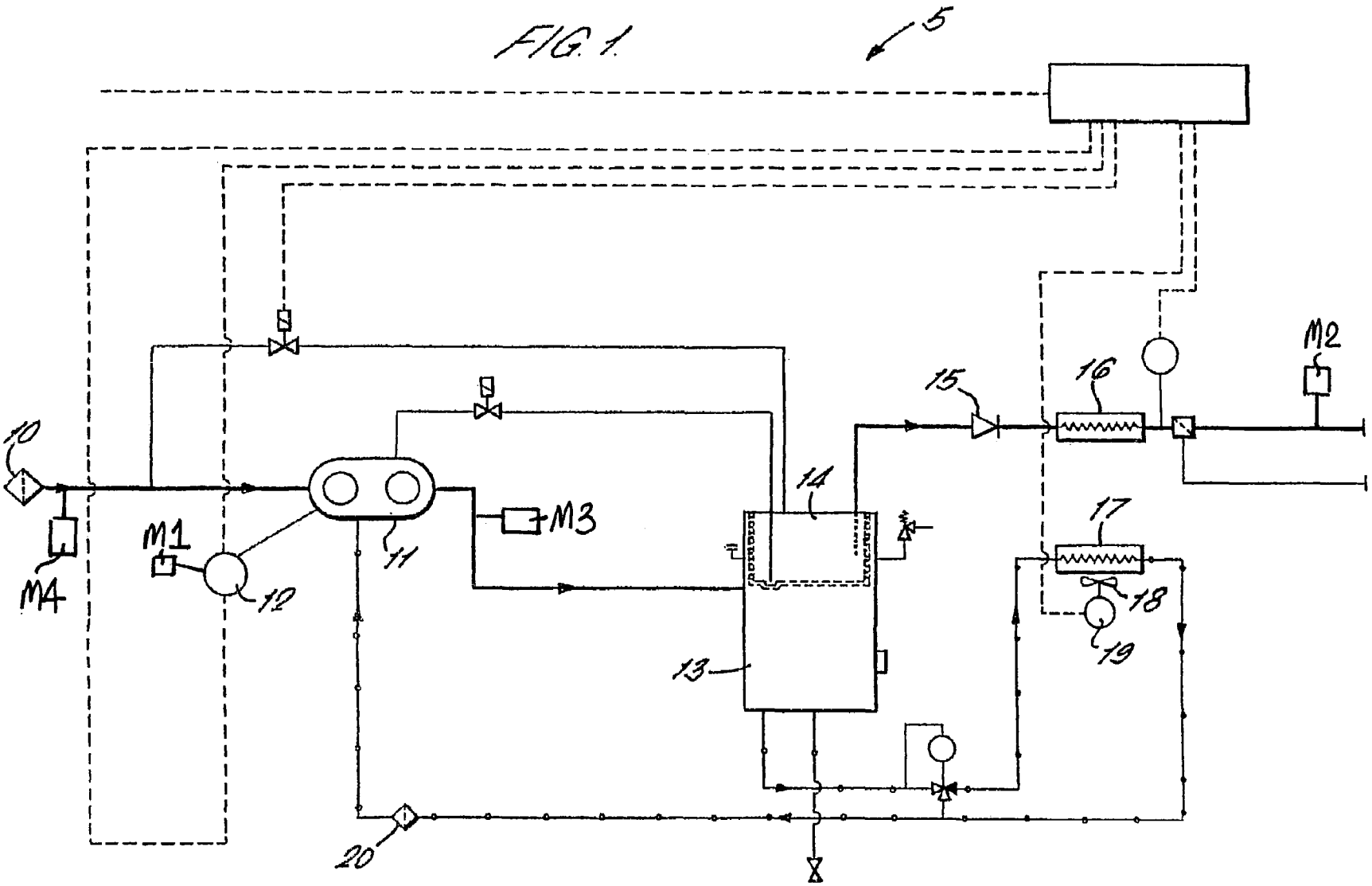

The invention relates to the use of variable speed control of the cooling fan on a variable speed oil-injected screw compressor.

2. The Prior Art

An oil-injected screw compressor comprising one or more stages of compression can be driven from a variable speed motor. The speed of the motor is controlled automatically to drive the compressor either at one of a series of pre-set speeds or to continuously adjust the speed so that the output volume of the compressor matches the demand.

The oil that is used to cool, lubricate and seal the compressor element is cooled in a radiator that uses ambient air as the cooling medium. A fan is used to pass air over the radiator. The term "oil" as used in this specifically also applies to, and is intended to cover, synthetic oils or other similar coolants.

Conventionally the fan is driven by a fixed speed electric motor, which runs continuously whilst the compressor is running. A thermostatically controlled by-pass valve is generally used as a means of diverting the oil away from the radiator until the oil temperature reaches a certain value. The valve currently used is operated by a self-contained wax capsule. As the oil temperature increases, the wax expands and operates the valve to divert the oil through the radiator.

In a variable speed compressor the quantity of heat rejected to the cooling oil varies with the speed and pressure at which the compressor is running. As the speed or pressure is reduced, less power is required and therefore less heat is rejected to the oil. Whilst running under light load, or in cool conditions, there is a tendency for the oil to overcool causing moisture in the compressed air to condense. Over a period of time, this water accumulates in the oil system. If this is not regularly drained, water will circulate with the oil causing damage to bearings and corroding ferrous surfaces.

It is therefore an object of the present invention to overcome these disadvantages.

The invention therefore comprises a screw compressor comprising at least one stage of compression, each compressor stage comprising a pair of rotors, variable speed compressor drive means for driving at least one of said rotors to effect air compression, an oil reclaimer for extracting oil from the compressed air, cooling apparatus for cooling oil extracted from the compressed air, wherein said cooling apparatus comprises a heat exchange device and a fan driven by a motor which can be run at different speeds to provide cooling air to the heat exchange device, said motor being independent from said variable speed compressor drive means, the speed of the fan motor being controlled by a control unit, the control unit comprising processing means for processing signals generated by a plurality of devices monitoring operating parameters of the compressor, at least one of which monitoring devices monitors the speed of the variable speed compressor drive means, said processing means calculating the input power of the compressor using a combination of the speed measurement and torque of the variable speed compressor drive means, and adjusting the speed of the fan proportionally to the input power to balance the heat rejected to the cooling air with heat rejection to the oil.

A preferred embodiment of the present invention will now be described, by way of example only, with reference to the accompanying drawing in which:

FIG. 1 is a schematic representation of a screw compressor according to the present invention.

Typically each compressor stage of a screw compressor 5 consists of a pair of helically fluted rotors supported at each end in rolling bearings. The following description covers the operation of a single stage compressor, but the invention applies in a similar manner to multi-stage machines. A variable speed motor 12 drives one rotor, which transmits the drive to the counter-rotating rotor. The variable speed motor 12 is used to drive the compressor 5 directly. An electronic control system continuously adjusts the speed of the compressors, within pre-set limits, so that the output flow matches the consumers demand to maintain the designated system pressure.

Air is drawn through an air filter 10 into the compressor by the action of the rotors. In the compression element 11, the air is compressed between the rotors and the casing. During this process oil, at a higher pressure than that of the air, is injected into the air through a port in the compressor casing. The oil cools, lubricates and seals the compressor element 11. The oil/air mixture is further compressed and is then discharged through a delivery port of the compression element 11 into an oil reclaimer 13. The oil is separated from the air in the reclaimer 13. The separated oil from the reclaimer 13 is then returned to the compression element 11 through an oil cooler, and an oil filter 20. The difference in air pressure between the reclaimer 13 and the injection point in the compression element 11 drives the oil through this circuit. The compressed air leaves the reclaimer 13 through a fine filter 14, a non-return valve 15 and, in most cases, an after-cooler 16.

The oil cooler comprises a radiator 17 and fan 18, which is driven by a motor and control unit 19.

The cooling oil is itself cooled in the radiator 17, which uses ambient air as a cooling medium. A fan 18 is used to pass a flow of air over the radiator 17.

A motor and control unit 19, drives the fan 18, which can be controlled to run automatically either at a number of different fixed speeds or the speed can be continuously varied, in response to control signals derived from certain parameters of the operating conditions of the compressor 5. This may be achieved by the use of one of the following alternatives:

i) a pole change (or similar) motor that can be switched to run at two or more speeds;

ii) an induction motor that can be run via an electronic drive at a number of pre-determined speeds or varied continuously in response to a control signal;

iii) a switched reluctance drive motor that can be run via an electronic drive at a number of pre-determined speeds or varied continuously in response to a control signal; or iv) any other form of electric variable speed drive.

The operating parameters of the compressor 5 are continuously monitored by any appropriate monitoring devices. A monitor M1 monitors speed and torque of the motor of the compressor drive, a monitor M2 monitors the air pressure of the air delivery point of the compressor 5 or at the discharge point of the compressor 5, a monitor M3 monitors oil temperature at the oil cooler outlet, a monitor M4 monitors ambient temperature and a monitor M5 monitors air/oil delivery temperature of the compressor stages, in particular the final stage. Signals are generated by the monitoring devices, which are fed to the electronic controller of the motor and control unit 19 and are processed to enable the controller to adjust the fan speed to modify the heat energy being rejected from the oil to the cooling air. Essentially, by measuring the torque and speed of the compressor drive, the input power to the compressor 5 can be calculated, and the speed of the motor driving the fan 18 is adjusted proportionally to the input power, so that the heat rejected to the cooling air balances the heat rejection to the oil. The input power could, alternatively be measured electrically using a kilowatt transducer. Essentially, by measuring the torque and speed of the compressor drive, the input power to the compressor 5 can be calculated, and the speed of the motor driving the fan 18 is adjusted proportionally to the input power, so that the heat rejected to the cooling air balances the heat rejection to the oil. The input power could, alternatively be measured electrically using a kilowatt transducer.

The oil temperature at the oil cooler outlet, or other measured parameters, is used to further adjust the speed of the fan 18 to compensate for variations n ambient temperature, cooler efficiency and fan performance.

A variable speed drive used on a compressor 5 of this type offers significant efficiency improvements under part load conditions. This is because matching the output of the compressor 5 to the demand by controlling the speed is more efficient than other means of capacity control.

However to have the cooling fan 18 running at full speed (and power) irrespective of the compressor load reduces the overall efficiency improvement. A variable speed fan will mean that the fan 18 only consumes the amount of energy necessary to cool the compressor oil.

A secondary benefit is that reducing the speed of the fan 18 will reduce the noise level of the compressor 5.

The invention claimed is:

1. A screw compressor(s) comprising at least one stage of compression, each compressor stage comprising a pair of rotors, variable speed compressor drive means for driving at least one of said rotors to effect air compression, an oil reclaimer for extracting oil from the compressed air, cooling apparatus for cooling oil extracted from the compressed air, wherein said cooling apparatus comprises a heat exchange device and a fan driven by a motor which can be run at different speeds to provide cooling air to the heat exchange device, said motor being independent from said variable speed compressor drive means, the speed of the fan motor being controlled by a control unit, the control unit comprising processing means for processing signals generated by a plurality of devices monitoring operating parameters of the compressor, at least one of which monitoring devices monitors the speed of the variable speed compressor drive means, said processing means calculating the input power of the compressor using a combination of the speed measurement and torque of the variable speed compressor drive means, and adjusting the speed of the fan proportionally to the input power to balance the heat rejected to the cooling air with heat rejection to the oil.

2. A screw compressor as claimed in claim 1 in which the fan motor can be run at a number of different fixed speeds, or the motor can be continuously varied.

3. A screw compressor as claimed in claim 1 in which at least one monitoring device monitors the torque of the variable speed compressor drive means.

4. A screw compressor as claimed in claim 1 in which at least one monitoring device monitors the torque of the variable speed compressor drive means.

5. A screw compressor as claimed in claim 1 in which at least one monitoring device monitors the pressure of the air compressor outlet.

6. A screw compressor as claimed in claim 1 in which at lest one monitoring device monitors the temperature of the oil at an outlet of the cooling apparatus.

7. A screw compressor as claimed in claim 1 in which at least one monitoring device monitors the ambient temperature.

8. A screw compressor as claimed in claim 1 in which at least one monitoring device monitors the air/oil delivery temperature of the final compression stage.

* * * * *